US010631078B2

(12) United States Patent
He

(10) Patent No.: US 10,631,078 B2
(45) Date of Patent: Apr. 21, 2020

(54) HEADSET

(71) Applicant: REALTEK SEMICONDUCTOR CORP., Hsinchu (TW)

(72) Inventor: Wei-Hung He, Hsinchu (TW)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 16/159,371

(22) Filed: Oct. 12, 2018

(65) Prior Publication Data

US 2019/0387306 A1 Dec. 19, 2019

(30) Foreign Application Priority Data

Jun. 15, 2018 (TW) ..... 107120862 A

(51) Int. Cl.
*H04R 5/04* (2006.01)
*H04R 1/10* (2006.01)
*H04R 5/033* (2006.01)

(52) U.S. Cl.
CPC ..... *H04R 1/1083* (2013.01); *H04R 1/105* (2013.01); *H04R 5/0335* (2013.01); *H04R 5/04* (2013.01)

(58) Field of Classification Search
CPC .... H04R 1/1083; H04R 1/105; H04R 5/0335; H04R 5/04
USPC ..... 381/58, 71.1, 71.6, 74, 313, 321, 330
See application file for complete search history.

(56) References Cited

U.S. PATENT DOCUMENTS 8,401,205 B2 3/2013 Itabashi et al.
8,675,885 B2 3/2014 Sapiejewski
8,909,524 B2 12/2014 Stoltz et al.
10,219,083 B2 * 2/2019 Farmani ..... H04R 1/1083
10,366,701 B1 * 7/2019 Su
2010/0278352 A1 * 11/2010 Petit ..... G10L 21/0208 381/71.1
2011/0288860 A1 11/2011 Schevciw et al.
2013/0170680 A1 * 7/2013 Gran ..... H04R 25/405 381/313
2015/0286459 A1 10/2015 Habets et al.
2016/0267899 A1 * 9/2016 Gauger, Jr. ..... G10K 11/175
2017/0208407 A1 * 7/2017 Sapozhnykov ..... H04R 3/005
2017/0289686 A1 * 10/2017 Faller ..... H04R 1/406
2018/0041849 A1 2/2018 Farmani et al.
2018/0150275 A1 * 5/2018 Mate ..... G06F 3/165
(Continued)

FOREIGN PATENT DOCUMENTS

CN 101198194 A 6/2008
TW 209093 7/1993

*Primary Examiner* — Paul Kim
*Assistant Examiner* — Friedrich Fahnert
(74) *Attorney, Agent, or Firm* — Birch, Stewart, Kolasch & Birch, LLP

(57) ABSTRACT

A headset includes a first sound receiving circuit, a second sound receiving circuit, an adaptive circuit, a first synthesis circuit, and a second synthesis circuit. The adaptive circuit is configured to: obtain a first direction of arrival and a second direction of arrival according to a first sound signal and a second sound signal; obtain a first conversion function and a second conversion function according to the first direction of arrival and the second direction of arrival; obtain a first feed forward audio signal according to the first conversion function and the first sound signal; and obtain a second feed forward audio signal according to the second conversion function and the second sound signal.

11 Claims, 17 Drawing Sheets

(56) References Cited

U.S. PATENT DOCUMENTS

2018/0294000 A1* 10/2018 Steele ..... H04R 3/005
2019/0014422 A1* 1/2019 Lunner ..... H04R 25/402

* cited by examiner

HEADSET

CROSS-REFERENCE TO RELATED APPLICATION

This non-provisional application claims priority under 35 U.S.C. § 119(a) to Patent Application 107120862 in Taiwan, R.O.C. on Jun. 15, 2018, the entire contents of which are hereby incorporated by reference.

BACKGROUND

Technical Field

The present disclosure relates to a headset, and in particular, to a feed forward headset.

Related Art

Currently, active anti-noise headsets are mainly in a hybrid structure, that is, a headset internally includes an external microphone, a filter, a speaker, and an error microphone. The external microphone detects an external noise. The filter generates a phase-inverted anti-noise signal of the noise according to the external noise. The speaker generates a to-be-output audio signal according to the anti-noise signal. The error microphone detects the audio signal output by the speaker, and uses the audio signal as a reference for the filter to generate the anti-noise signal.

SUMMARY

The inventor finds a technical problem that when a user wears a headset, times required by external noises from a plurality of different directions to reach an external microphone are different from times required by the external noises to reach an ear, consequently, the external noises that reach the ear cannot be effectively reduced by using a fixed anti-noise parameter, and a main external noise from a specific direction cannot be found from the external noises from the plurality of different directions, and cannot be reduced or even offset. In addition, the headset including the external microphone and an error microphone is not only heavy in weight and large in size, but also high in power consumption.

The inventor further finds another technical problem that when the external microphone detects a wind sound, the wind sound cannot be reduced by using the fixed anti-noise parameter because the wind sound detected by the external microphone has an extremely low correlation with a sound received by the error microphone. In addition, when the external microphone simultaneously detects the external noises from different directions and the wind sound, the main external noise from the specific direction cannot be canceled or the wind sound cannot be reduced by using the fixed anti-noise parameter.

In view of the foregoing problems, an embodiment of the present disclosure describes a headset, including a first sound receiving circuit, a second sound receiving circuit, an adaptive circuit, a first synthesis circuit, and a second synthesis circuit. The first sound receiving circuit is configured to: receive a first sound of a first position, and convert the first sound into a first sound signal. The second sound receiving circuit is configured to: receive a second sound of a second position, and convert the second sound into a second sound signal. The adaptive circuit is configured to: obtain a first direction of arrival and a second direction of arrival according to the first sound signal and the second sound signal; obtain a first conversion function and a second conversion function according to the first direction of arrival and the second direction of arrival; obtain a first feed forward audio signal according to the first conversion function and the first sound signal; and obtain a second feed forward audio signal according to the second conversion function and the second sound signal. The first synthesis circuit is configured to: mix a first input audio signal and the first feed forward audio signal, and output a first output audio signal. The second synthesis circuit is configured to: mix a second input audio signal and the second feed forward audio signal, and output a second output audio signal. Therefore, a phase at which the first feed forward audio signal output by the adaptive circuit of this embodiment of the present disclosure reaches a portion that is of a first speaker circuit and that is close to a left ear is inverted to a phase at which the first sound reaches the portion, so that the first output audio signal approaches the first input audio signal; and a phase at which the second feed forward audio signal reaches a portion that is of a second speaker circuit and that is close to a right ear is inverted to a phase at which the second sound reaches the portion, so that the second output audio signal approaches the second input audio signal. In addition, a structure of this embodiment of the present disclosure is not only light in weight and small in size, but also low in power consumption.

In some embodiments, the headset further includes a wind noise feedback circuit. The wind noise feedback circuit is configured to: receive the first sound signal and the second sound signal, and output a corresponding wind noise audio signal when determining that a wind noise intensity of the first sound signal and the second sound signal is less than a preset value, where the first synthesis circuit is configured to: mix the first input audio signal, the first feed forward audio signal, and the wind noise audio signal, and output the first output audio signal; and the second synthesis circuit is configured to: mix the second input audio signal, the second feed forward audio signal, and the wind noise audio signal, and output the second output audio signal. Therefore, the wind noise feedback circuit may determine the wind noise intensity by using the preset value, and output the corresponding wind noise audio signal, so that the first output audio signal approaches the first input audio signal, and the second output audio signal approaches the second input audio signal.

In some embodiments, the headset further includes a wind noise feedback circuit. The wind noise feedback circuit is configured to: receive the first sound signal and the second sound signal, and output a corresponding wind noise parameter when determining that a wind noise intensity of the first sound signal and the second sound signal is less than a preset value, where the adaptive circuit is configured to: obtain the first feed forward audio signal according to the first conversion function, the first sound signal, and the wind noise parameter; and obtain the second feed forward audio signal according to the second conversion function, the second sound signal, and the wind noise parameter. Therefore, the adaptive circuit reduces intensities of the first feed forward audio signal and the second feed forward audio signal, so that the first output audio signal approaches the first input audio signal, and the second output audio signal approaches the second input audio signal.

Another embodiment of the present disclosure describes a headset, including a first sound receiving circuit, a second sound receiving circuit, and an adaptive circuit. The first sound receiving circuit is configured to: receive a first sound of a first position, and convert the first sound into a first sound signal. The second sound receiving circuit is configured to: receive a second sound of a second position, and convert the second sound into a second sound signal. The adaptive circuit is configured to: obtain a first direction of arrival and a second direction of arrival according to the first sound signal and the second sound signal; obtain a first conversion function and a second conversion function according to the first direction of arrival and the second direction of arrival; output a first feed forward audio signal according to the first conversion function and the first sound signal; and output a second feed forward audio signal according to the second conversion function and the second sound signal. Therefore, a phase at which the first feed forward audio signal output by the adaptive circuit reaches a first speaker circuit is inverted to a phase at which the first sound reaches the first speaker circuit, and a phase at which the second feed forward audio signal reaches a second speaker circuit is inverted to a phase at which the second sound reaches the second speaker circuit, so that the first feed forward audio signal can cancel the first sound that reaches the first speaker circuit, and the second feed forward audio signal may cancel the second sound that reaches the second speaker circuit. In addition, a structure of this embodiment of the present disclosure is not only light in weight and small in size, but also low in power consumption.

DETAILED DESCRIPTION

Figure 1:
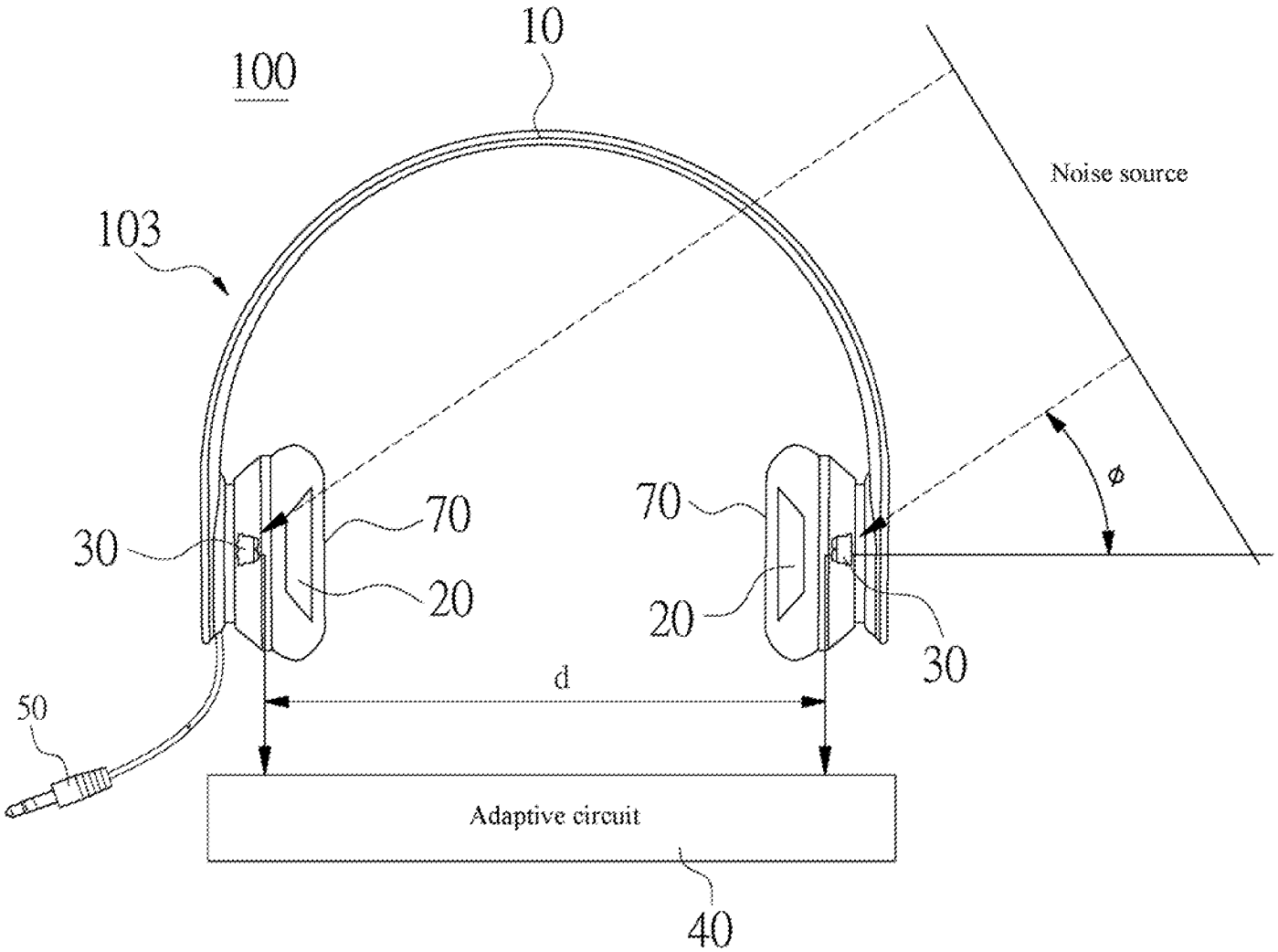
FIG. 1 is a schematic diagram of a hardware structure of a headset according to Embodiment 1 of the present disclosure.
Figure 2:
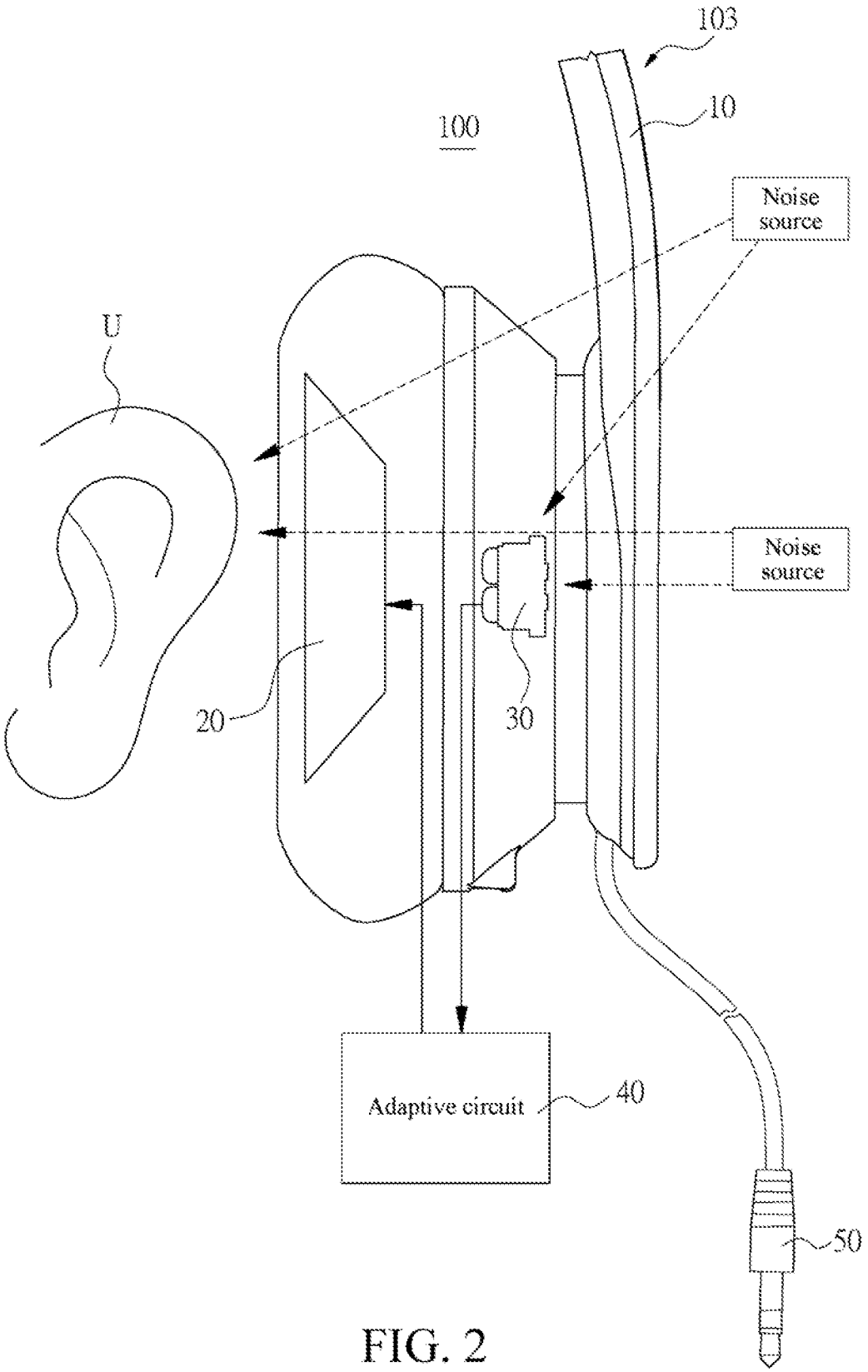
FIG. 2 is a schematic diagram of a local hardware structure of a headset according to Embodiment 1 of the present disclosure.

Referring to FIG. 1 and FIG. 2, Embodiment 1 of the present disclosure describes a headset 100, for example, a circumaural headphone 103. The headset 100 includes a housing 10, a first sound receiving circuit 31, a second receiving circuit 32, an adaptive circuit 40, an audio source cable 50, a first speaker circuit 21, and a second speaker circuit 22. The first sound receiving circuit 31 and the second receiving circuit 32 are respectively disposed at two opposite ends of the housing 10 and are symmetrical to each other, and are configured to receive sounds and convert the sounds into sound signals. The sound signals may be a wind sound or a noise; may be monophony or polyphony; and may be of a single frequency or a plurality of frequencies. The adaptive circuit 40 is electrically connected to a sound receiving circuit 30. The audio source cable 50 is electrically connected to the adaptive circuit 40, and is configured to respectively transmit an input audio signal to the first speaker circuit 21 and the second speaker circuit 22 for output. The input audio signal may be an audio signal obtained after digital multimedia in different formats is decoded. The input audio signal may be analog or digital multimedia, or may be a same input audio signal or different input audio signals.

The first sound receiving circuit 31 includes a first microphone and a first analog to digital converter (ADC) circuit that are configured to receive a first sound of a first position and convert the first sound into a first sound signal. Specifically, the first microphone is configured to receive one or more sounds, for example, a noise source, that reach the first position. The first position corresponds to a left ear area of a person. The first microphone converts the received sound into a first analog signal. The first ADC circuit converts the first analog signal into a first digital signal (collectively referred to as a sound signal in the following). For example, the first sound receiving circuit 31 receives a first noise of a noise source that reaches the left ear area, and converts the first noise into a first noise signal.

The second sound receiving circuit 32 includes a second microphone and a second ADC circuit that are configured to receive a second sound of a second position and convert the second sound into a second sound signal. Specifically, the second microphone is configured to receive one or more sounds, for example, a noise source, that reach the second position. The second position corresponds to a right ear area of the person. The second microphone converts the received sound into a second analog signal. The second ADC circuit converts the second analog signal into the second sound signal. For example, the second sound receiving circuit 32 receives a second noise of a noise source that reaches the right ear area, and converts the second noise into a second noise signal. The present disclosure describes the left ear area and the right ear area by using the first position and the second position, however, the first position and the second position of the present invention are not limited to the left ear area or the right ear area.

The adaptive circuit 40 performs an algorithm based on active noise cancellation (ANC) by using an operating apparatus such as a microprocessor or an application-specific integrated circuit (ASIC), and is configured to: obtain a first direction of arrival Ø and a second direction of arrival Ø according to the first sound signal and the second sound signal; obtain a first conversion function and a second conversion function according to the first direction of arrival Ø and the second direction of arrival Ø; obtain a first feed forward audio signal according to the first conversion function and the first sound signal; and obtain a second feed forward audio signal according to the second conversion function and the second sound signal, so as to reduce or cancel the first sound received by the first sound receiving circuit 31 and the second sound received by the second sound receiving circuit 32.

Referring to FIG. 1 to FIG. 4 together, the adaptive circuit 40 includes an arrival detection circuit 41, a conversion function circuit 43 electrically connected to the arrival detection circuit 41, a first feed forward circuit 44 electrically connected to the conversion function circuit 43, and a second feed forward circuit 45 electrically connected to the conversion function circuit 43.

The arrival detection circuit 41 may be an operating apparatus such as a central processing unit, a microprocessor, or an ASIC that can perform an algorithm and control a peripheral apparatus, and is configured to obtain the first direction of arrival ϕ of the first sound signal and the second direction of arrival ϕ of the second sound signal according to the first sound signal and the second sound signal from a same noise source. Specifically, the arrival detection circuit 41 determines the first direction of arrival ϕ of the first sound signal and the second direction of arrival ϕ of the second sound signal according to frequencies of the first sound signal and the second sound signal and a distance d between the left ear area and the right ear area of the person. If the second sound signal is greater than or equal to the first sound signal, a horizontal direction of the first sound receiving circuit is defined as 0°, and a direction of arrival ϕ may be less than or equal to 180° and greater than or equal to 0°, but is not limited hereto.

The conversion function circuit 43 may be a storage unit such as a static random access memory or a dynamic random access memory, configured to store a lookup table. The lookup table includes a plurality of transfer functions corresponding to different directions of arrival, for example, frequency response. Specifically, the conversion function circuit 43 uses the first direction of arrival ϕ and the second direction of arrival ϕ output by the arrival detection circuit 41 as a first indicator for canceling the first sound signal or a second indicator for canceling the second sound signal, and obtains, through searching the lookup table, a first transfer function corresponding to the first indicator or a second transfer function corresponding to the second indicator. The first transfer function has an inverted phase with a low-frequency audio signal of the first sound signal, and is configured to dynamically correct a first preset feed forward parameter configured in the first feed forward circuit 44; and the second transfer function has an inverted phase with a low-frequency audio signal of the second sound signal, and is configured to dynamically correct a second preset feed forward parameter configured in the second feed forward circuit 45, so as to cancel the first sound signal and the second sound signal. Further, the conversion transfer function circuit 43 may further suppress high-frequency signals in the first sound signal and the second sound signal according to the first preset feed forward parameter and the second preset feed forward parameter. An artificial ear is disposed in a laboratory in which no material that absorbs a sound is configured, and by using sounds transmitted by one or more noise sources, a lookup table of a plurality of directions of arrival in which the sounds reaches the artificial ear is established, to obtain transfer functions corresponding to the plurality of directions of arrival. In the lookup table, a frequency response of each sound signal corresponds to a plurality of phase differences and a plurality of gains, so that the arrival detection circuit 41 uses a frequency response of each direction of arrival as an indicator to search for phase differences or gains corresponding to the indicator. The arrival detection circuit 41 determines the directions of arrival ϕ of the first sound signal and the second sound signal by using the following operation formula:

$$\Delta\tau(k,l)=\mathrm{imag}(Y_R(k,l)/Y_L(k,l))/2\pi f_k \quad (1)$$

$$\phi(k,l)=\cos^{-1}(\Delta\tau(k,l)*c/d),0<=\hat{\phi}(k,l)<=180° \quad (2)$$

where $\Delta\tau(k,l)$ is a phase difference between the first sound signal reaching the first sound receiving circuit 31 and the second sound signal reaching the second sound receiving circuit 32, k is the $k^{th}$ frequency band of the first sound signal and the second sound signal, and l is the $l^{th}$ frame time of the first sound signal and the second sound signal;

$Y_L(k,l)$ is the first sound signal corresponding to the left ear area of the person;

$Y_R(k,l)$ is the second sound signal corresponding to the right ear area of the person;

$f_k$ is the $k^{th}$ frequency band of the first sound signal and the second sound signal;

$\phi(k,l)$ is the direction of arrival corresponding to the phase difference;

c is 340 meters/second; and d is a distance between the first sound signal and the second sound signal.

The first feed forward circuit 44 and the second feed forward circuit 45 may be feed forward filters such as infinite impulse response (IIR) filters or finite impulse response (FIR) filters, or hybrid filters. The first feed forward circuit 44 and the second feed forward circuit 45 may be symmetrical to each other on configuration positions. The first feed forward circuit 44 is configured to obtain a first feed forward audio signal according to the first conversion function and the first sound signal, and the first feed forward audio signal and the first sound signal have inverted phases and similar or same gains. A motion mechanism of the second feed forward circuit 45 is the same as that of the first feed forward circuit 44, and details are not described herein again. Further, the first feed forward circuit 44 is located at the first position and configures the first preset feed forward parameter, where the first position corresponds to the left ear area of the person. The second feed forward circuit 45 is located at the second position and configures the second preset feed forward parameter, where the second position corresponds to the right ear area of the person. The preset feed forward parameter may be the frequency response of the first sound signal or the second sound signal, and is configured to reduce the first sound signal of the first sound receiving circuit 31 and the second sound signal of the second sound receiving circuit 32. That is, the first feed forward circuit 44 adjusts the first preset feed forward parameter by using the first transfer function, and outputs the first feed forward audio signal to cancel the first sound signal; and the second feed forward circuit 45 adjusts the second preset feed forward parameter by using the second transfer function, and outputs the second feed forward audio signal to cancel the second sound signal.

Figure 4:
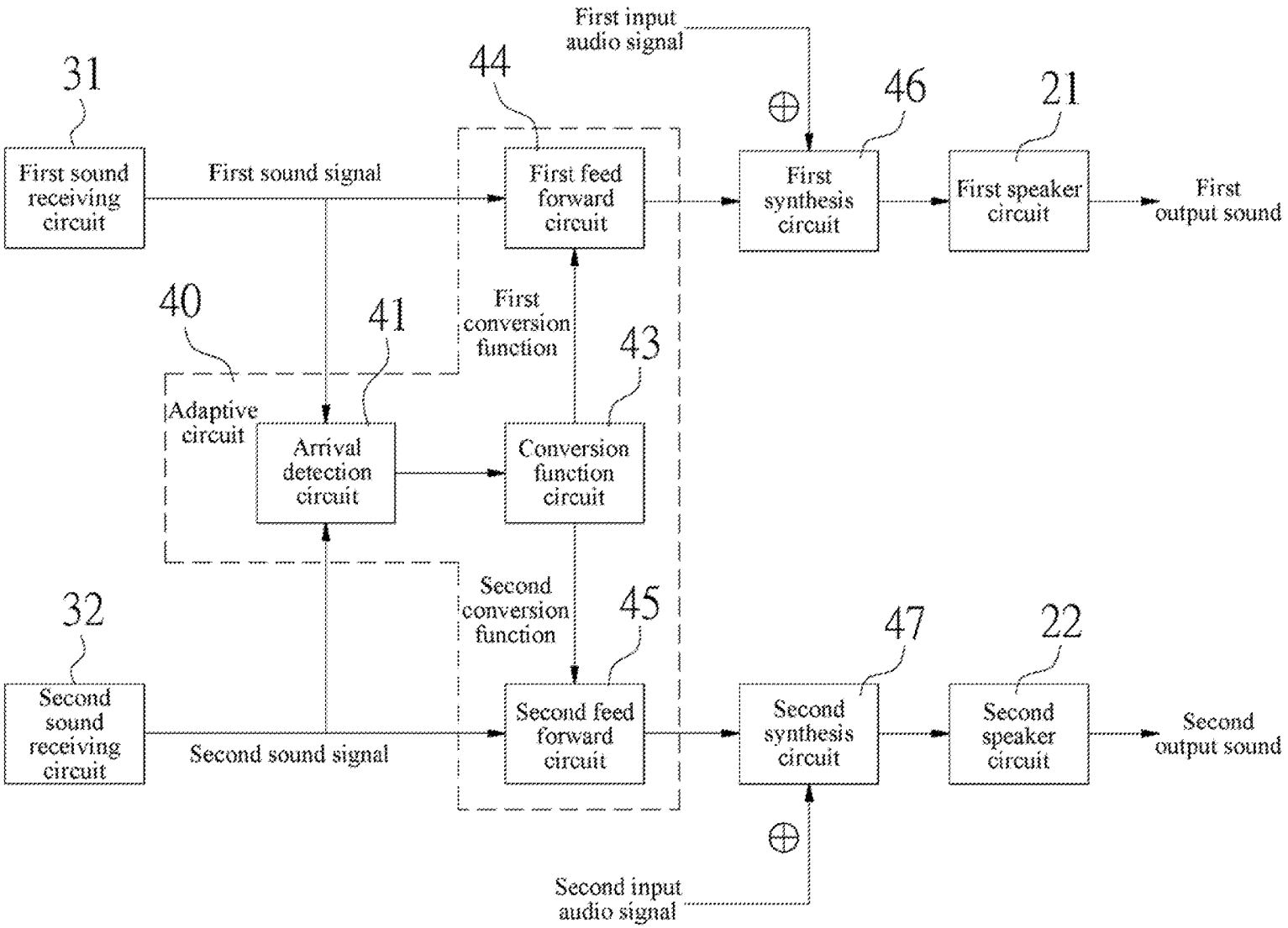
FIG. 4 is a schematic diagram of a circuit structure of a headset according to Embodiment 2 of the present disclosure.

Still referring to FIG. 4, the first speaker circuit 21 is disposed at the first position, is configured to convert a first output audio signal into a first output sound, and includes a first digital to analog converter, a first speaker drive unit, and a first speaker. The second speaker circuit 22 is disposed at the second position, is configured to convert a second output audio signal into a second output sound, and includes a second digital to analog converter, a second speaker drive unit, and a second speaker. The first digital to analog converter is configured to converts the first output audio signal into the first output sound. The second digital to analog converter is configured to converts the second output audio signal into the second output sound. The first speaker drive unit and the second speaker drive unit may be a dynamic driver, an electrostatic driver, and a planar magnetic driver, and are respectively configured to drive the first speaker and the second speaker. Further, the first speaker circuit 21 and the second speaker circuit 22 may receive a same output audio signal, including a human sound or a musical instrument sound, and the first speaker circuit 21 outputs a first analog sound (collectively referred to as an output audio signal in the following), for example, the human sound, and the second speaker circuit 22 outputs the second output audio signal, for example, the instrument sound.

Figure 3:
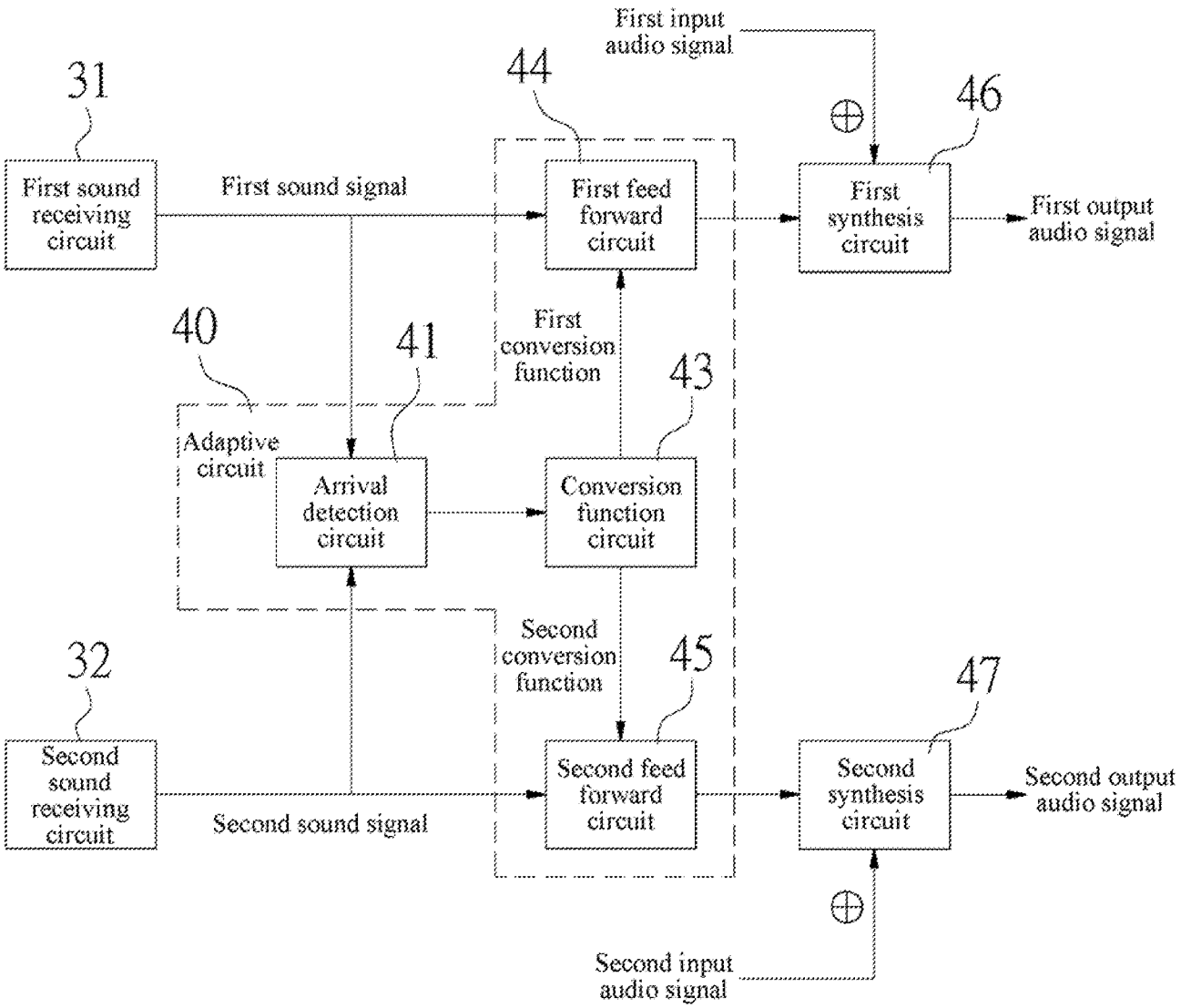
FIG. 3 is a schematic diagram of a circuit structure of a headset according to Embodiment 1 of the present disclosure.

Still referring to FIG. 3 and FIG. 4, the headset 100 further includes a first synthesis circuit 46 and a second synthesis circuit 47. The first synthesis circuit 46 may be a summator, and is configured to: mix a first input audio signal and the first feed forward audio signal, and output the first output audio signal. The second synthesis circuit 47 may be a summator, and is configured to: mix a second input audio signal and the second feed forward audio signal, and output the second output audio signal.

Figure 5:
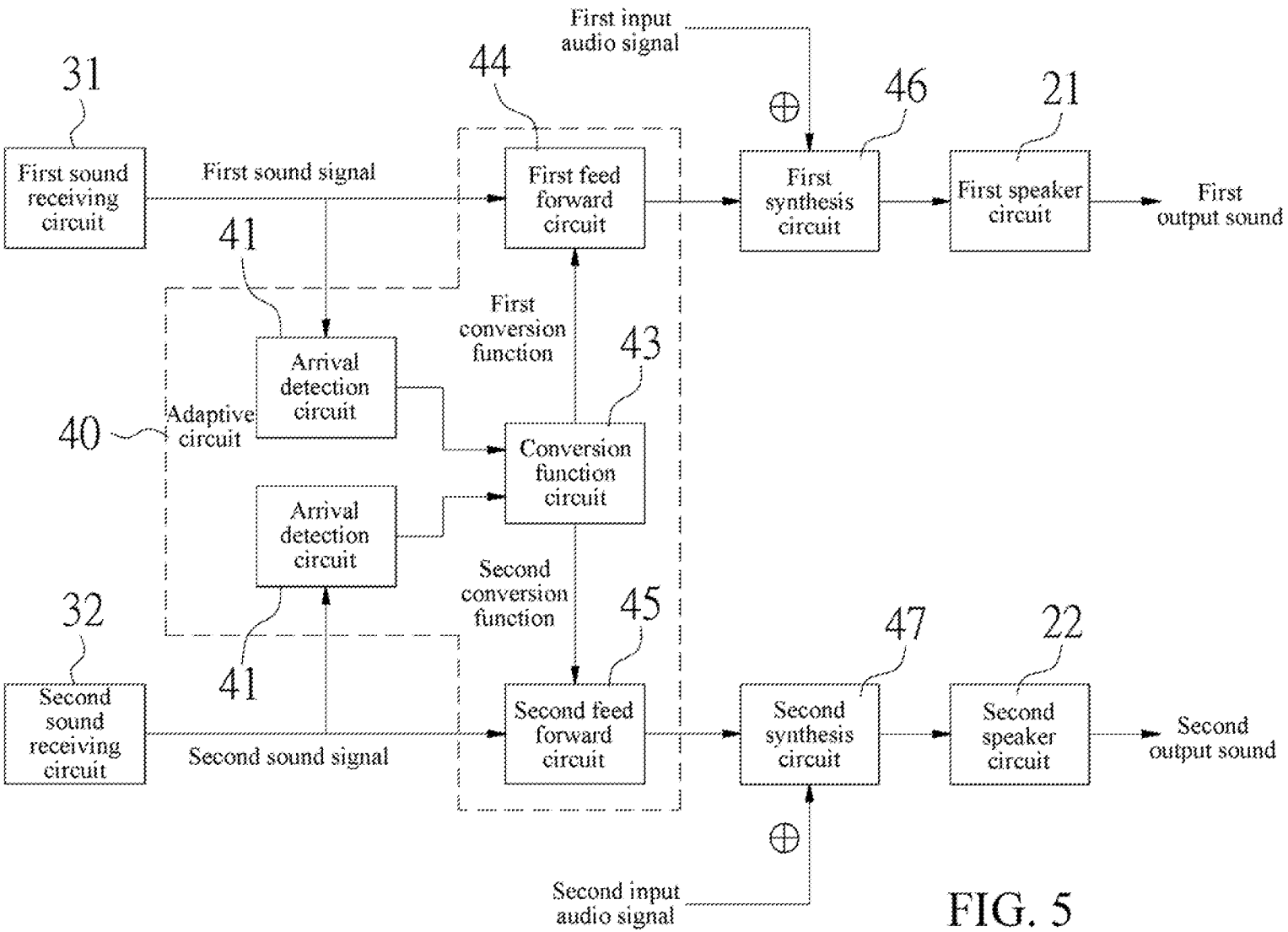
FIG. 5 is a schematic diagram of a circuit structure of an adaptive circuit according to FIG. 4.

In some embodiments, as shown in FIG. 5, there may be at least two arrival detection circuits 41, one is disposed at the first position, and the other one is disposed at the second position.

Figure 6:
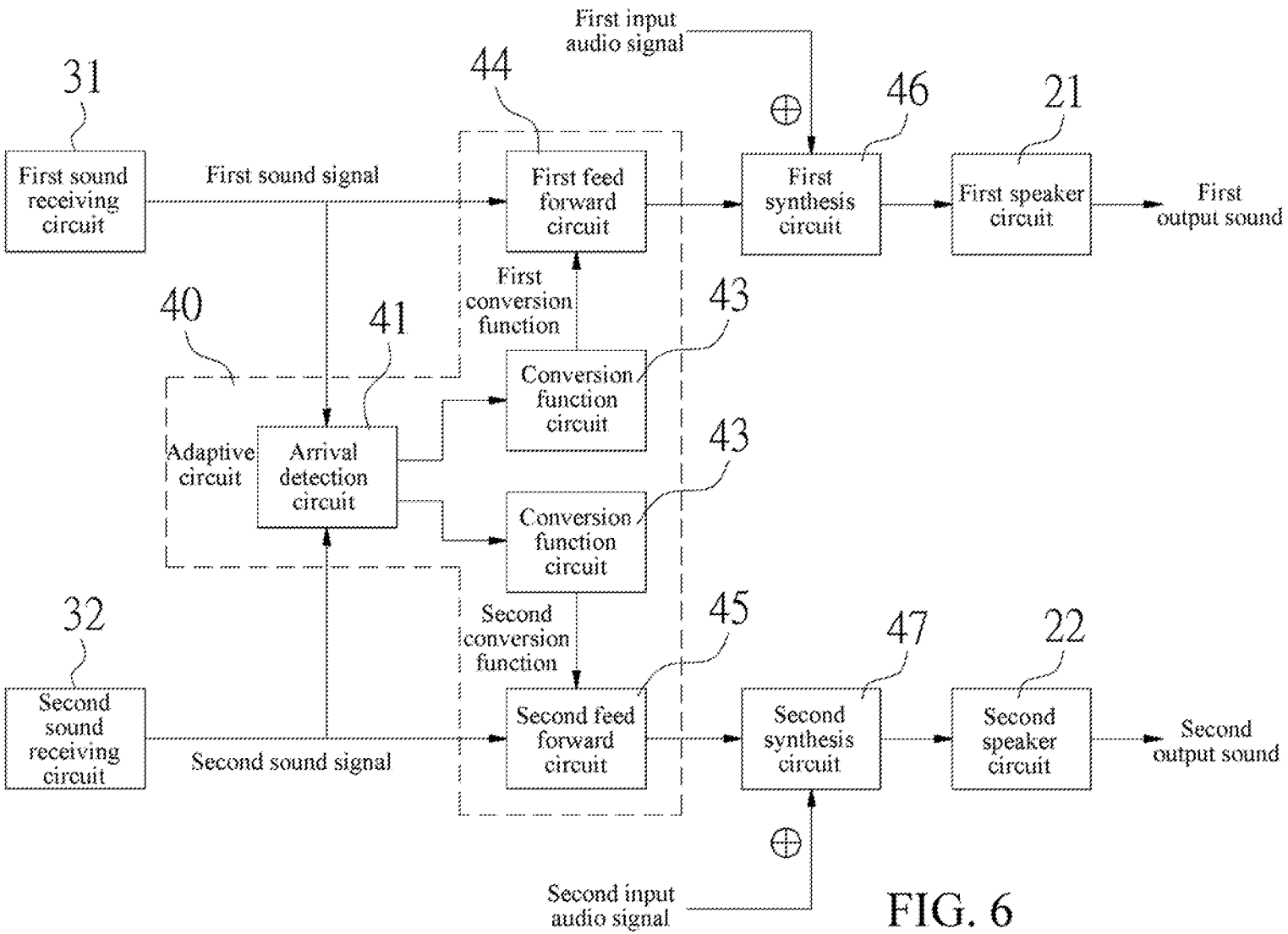
FIG. 6 is a schematic diagram of a circuit structure of an adaptive circuit according to FIG. 4.

In some embodiments, as shown in FIG. 6, the headset 100 may include at least two conversion function circuits 43, one is disposed at the adaptive circuit 40 at the first position, and the other one is disposed at the adaptive circuit 40 at the second position.

Figure 7:
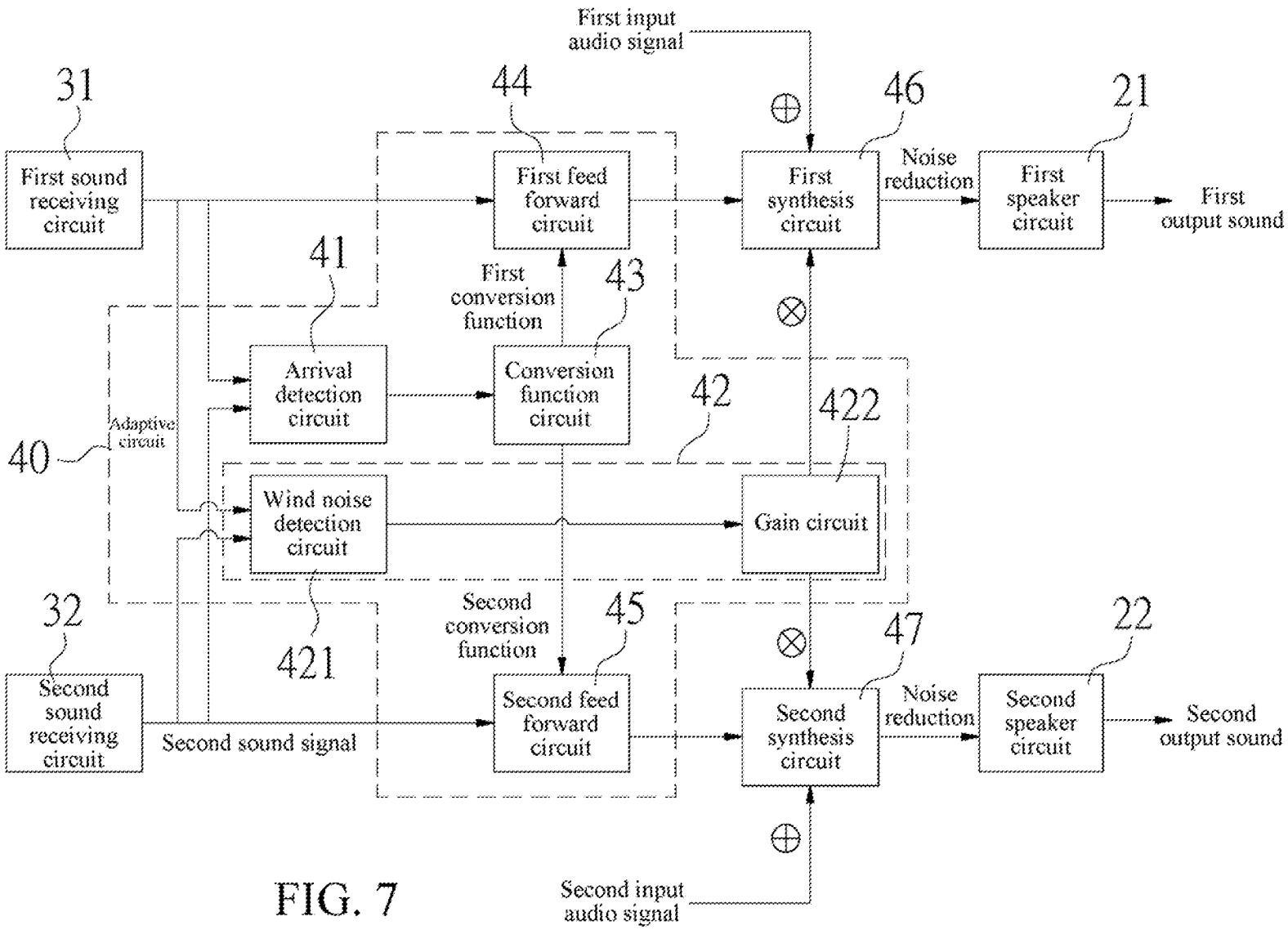
FIG. 7 is a schematic diagram of a circuit structure of a headset according to Embodiment 2 of the present disclosure.

Referring to FIG. 7, Embodiment 2 of the present disclosure describes a headset 100. A difference between Embodiment 2 and Embodiment 1 lies in that an adaptive circuit 40 further includes a wind noise feedback circuit 42, configured to: receive a first sound signal and a second sound signal, and output a corresponding wind noise audio signal when determining that a wind noise intensity of the first sound signal and the second sound signal is less than a preset value, to reduce loudness of the first feed forward audio signal or the second feed forward audio signal. A first synthesis circuit 46 includes a multiplier and a summator, and outputs a first output audio signal, so that the first output audio signal approaches a first input audio signal. The multiplier is configured to: mix a first feed forward audio signal and the wind noise audio signal, and output a first feed forward audio signal whose loudness is reduced. The summator is configured to mix the first input audio signal and the first feed forward audio signal whose loudness is reduced, and output the first output audio signal. A second synthesis circuit 47 includes a multiplier and a summator, and outputs a second output audio signal, so that the second output audio signal approaches a second input audio signal. The multiplier is configured to: mix a second feed forward audio signal and the wind noise audio signal, and output a second feed forward audio signal whose loudness is reduced. The summator is configured to mix the second input audio signal and the second feed forward audio signal whose loudness is reduced, and output the second output audio signal. Specifically, the wind noise feedback circuit 42 performs an algorithm by using the operating apparatus, and is configured to obtain one or more coherence functions corresponding to different frequency bands of the sound signal according to an auto-spectrum power of the first sound signal, an auto-spectrum power of the second sound signal, and a cross-spectrum power of the first sound signal and the second sound signal, to determine whether there is a correlation between phases of the first sound signal and the second signal. The wind noise feedback circuit 42 determines whether there is a correlation between the phases of the first sound signal and the second signal according to the following operation algorithm:

$$C_{LR}(\omega) = \frac{|P_{LR}(\omega)|^2}{P_{LL}(\omega)P_{RR}(\omega)}$$

where $P_{LL}(\omega)$ is an auto-spectrum power corresponding to the left ear area of the person, $P_{RR}(\omega)$ is an auto-spectrum power corresponding to the right ear area of the person, and $P_{LR}(\omega)$ is a cross-spectrum power corresponding to the left ear area and the right ear area of the person, and each coherence function corresponds to a frequency band of the sound signal. When the coherence function $C_{LR}(\omega)$ is less than the preset value, the wind noise feedback circuit 42 determines that one of the first sound signal and the second sound signal is a wind noise, and outputs a corresponding gain. When the coherence function is greater than the preset value, the wind noise feedback circuit 42 determines that the first sound signal and the second sound signal are noises, and output a gain of 1. For example, if $C_{LR}(\omega)>0.7$, the gain equals 1; and if $C_{LR}(\omega)<0.5$, the gain equals 0.

The wind noise feedback circuit 42 includes a wind noise detection circuit 421 and a gain circuit 422 electrically connected to the wind noise detection circuit 421. The wind noise detection circuit 421 may be the operating device, configured to: receive the first sound signal and the second sound signal, and output a wind noise figure when determining that the wind noise intensity of the first sound signal and the second sound signal is less than the preset value. The preset value is greater than or equal to 0 and less than or equal to 1. The wind noise figure may be the coherence function, and details are not described herein again. The gain circuit 422 may be a gain amplifier, configured to output the wind noise audio signal corresponding to the wind noise figure. The wind noise audio signal has different phases and gains corresponding to different frequency responses, to adjust loudness of a wind noise. Further, the gain circuit 422 configures a lookup table, including a plurality of wind noise figures and wind noise audio signals corresponding to the wind noise figures. The lookup table is established between a wind noise figure of a correlation between a first sound and a second sound and a wind noise audio signal corresponding to the wind noise figure by means of disposing a left artificial ear and a right artificial ear in a laboratory in which no material that absorbs a sound is configured and according to the first sound received by the left artificial ear and the second sound received by the right artificial ear. Further, if the wind noise detection circuit 421 determines that the wind noise intensity is much less than the preset value, for example, the wind noise figure is less than ten times of the preset value, the gain circuit 422 stops outputting the wind noise audio signal.

Figure 8:
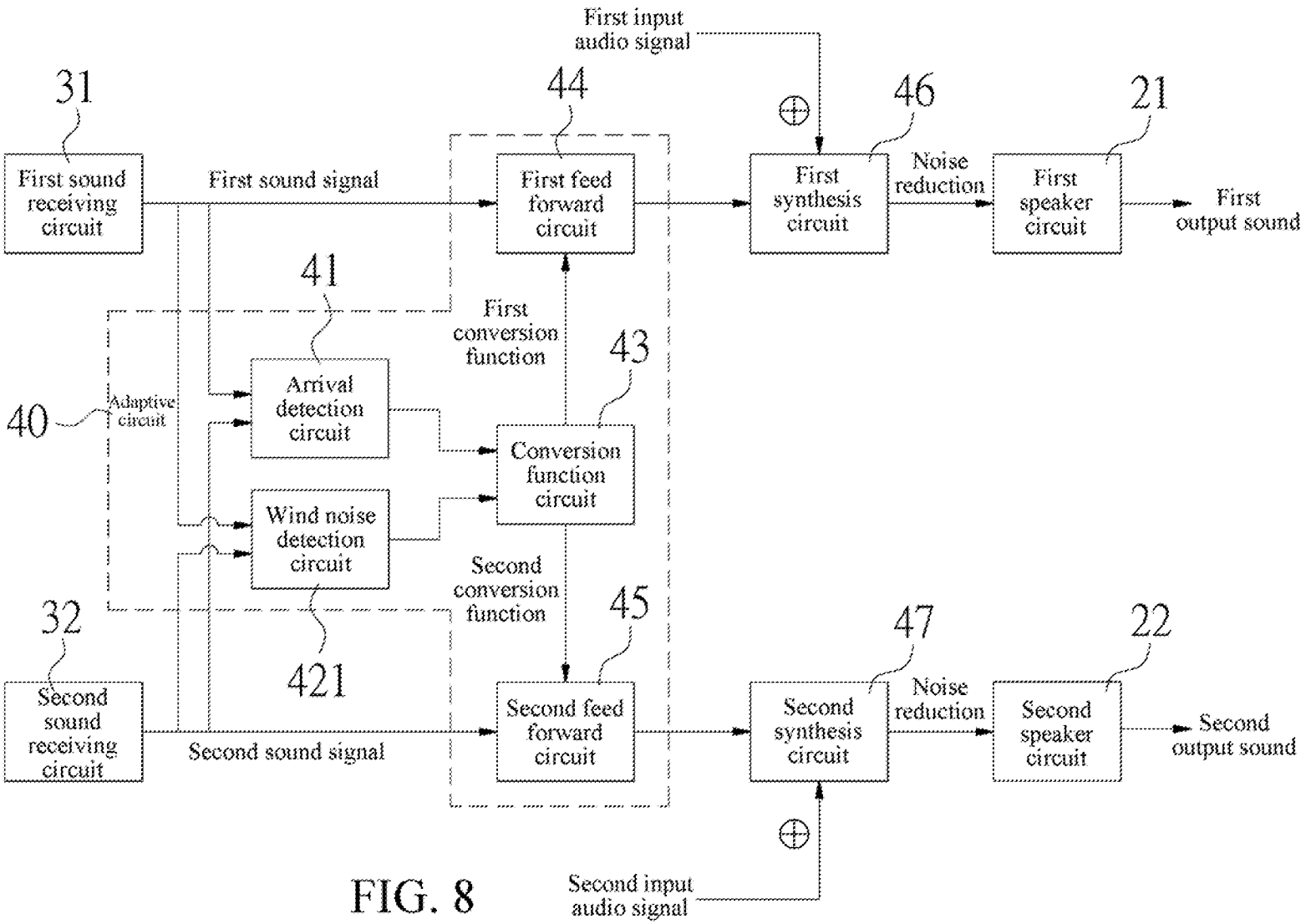
FIG. 8 is a schematic diagram of a circuit structure of a headset according to Embodiment 3 of the present disclosure.

Referring to FIG. 8, Embodiment 3 of the present disclosure describes a headset 100. A difference between Embodiment 3 and Embodiment 1 lies in that an adaptive circuit 40 further includes a wind noise feedback circuit 42, configured to: receive a first sound signal and a second sound signal, and output a corresponding wind noise parameter when determining that a wind noise intensity of the first sound signal and the second sound signal is less than a preset value. Specifically, the wind noise feedback circuit 42 is a wind noise detection circuit 421, configured to output the wind noise parameter according to the first sound signal and the second sound signal. A conversion function circuit 43 includes a lookup table between a plurality of directions of arrival ϕ and transfer functions corresponding to the directions of arrival, and a lookup table between a wind noise figure and a wind noise parameter corresponding to the wind noise figure. That is, the conversion function circuit 43 obtains, through searching the lookup tables, a corresponding transfer function and a corresponding wind noise parameter by using a direction of arrival ϕ output by the arrival detection circuit 41 and a wind noise figure output by the wind noise detection circuit 421 as indicators. A first feed forward circuit 44 obtains a first feed forward audio signal according to a first transfer function, the first sound signal, and the wind noise parameter, or a second feed forward circuit 45 obtains a second feed forward audio signal according to a second transfer function, the second sound signal, and the wind noise parameter. The first transfer function, the second transfer function, and the wind noise parameter are used for dynamically correcting a preset feed forward parameter configured in the first feed forward circuit 44 or the second feed forward circuit 45, so that a first output audio signal and a second output audio signal respectively approach a first input audio signal and a second input audio signal, so as to reduce loudness of the first feed forward audio signal and the second feed forward audio signal.

Figure 9:
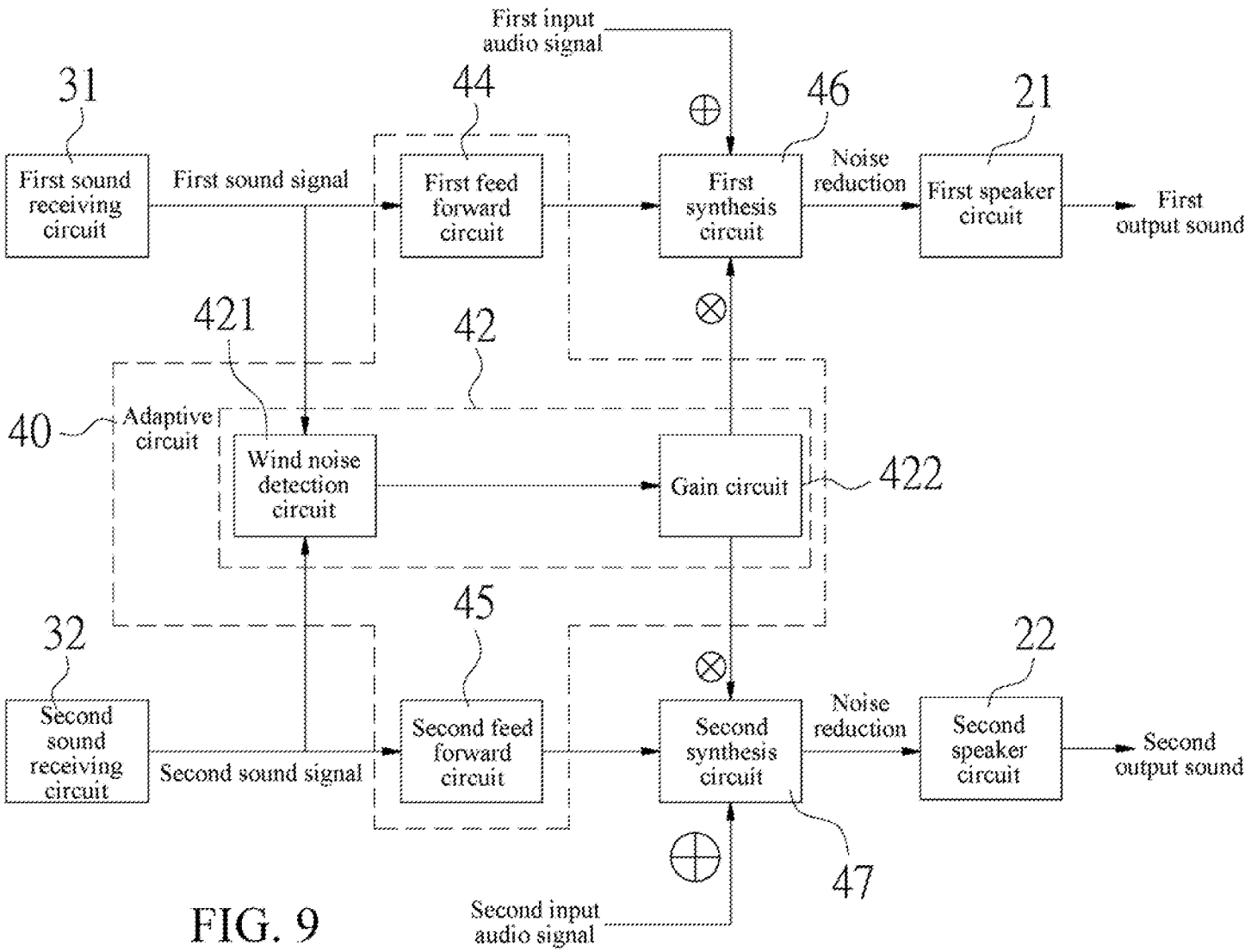
FIG. 9 is a schematic diagram of a circuit structure of a headset according to Embodiment 4 of the present disclosure.

Referring to FIG. 9, Embodiment 4 of the present disclosure describes a headset 100. A difference between Embodiment 4 and Embodiment I lies in that an adaptive circuit 40 does not include an arrival detection circuit 41 and a conversion function circuit 43, but only includes a wind noise feedback circuit 42. The wind noise feedback circuit 42 outputs a wind noise audio signal according to a wind noise figure, to reduce loudness of a first feed forward audio signal and a second feed forward audio signal. For example, a wind noise detection circuit 421 obtains the wind noise figure according to a first sound signal and a second sound signal. A gain circuit 422 obtains a wind noise audio signal according to the wind noise figure. A first synthesis circuit 46 obtains a first output audio signal according to the first feed forward audio signal (that is, a preset feed forward parameter), a first input audio signal, and the wind noise audio signal. A second synthesis circuit 47 obtains a second output audio signal according to the second feed forward audio signal (that is, a preset feed forward parameter), a second input audio signal, and the wind noise audio signal. In some other embodiments, according to a scheduling, the adaptive circuit 40 starts the wind noise feedback circuit 42 and closes the arrival detection circuit 41 and the conversion function circuit 43 when determining a wind noise; and starts the arrival detection circuit 41 and the conversion function circuit 43 and closes the wind noise feedback circuit 42 when determining a noise.

Figure 10:
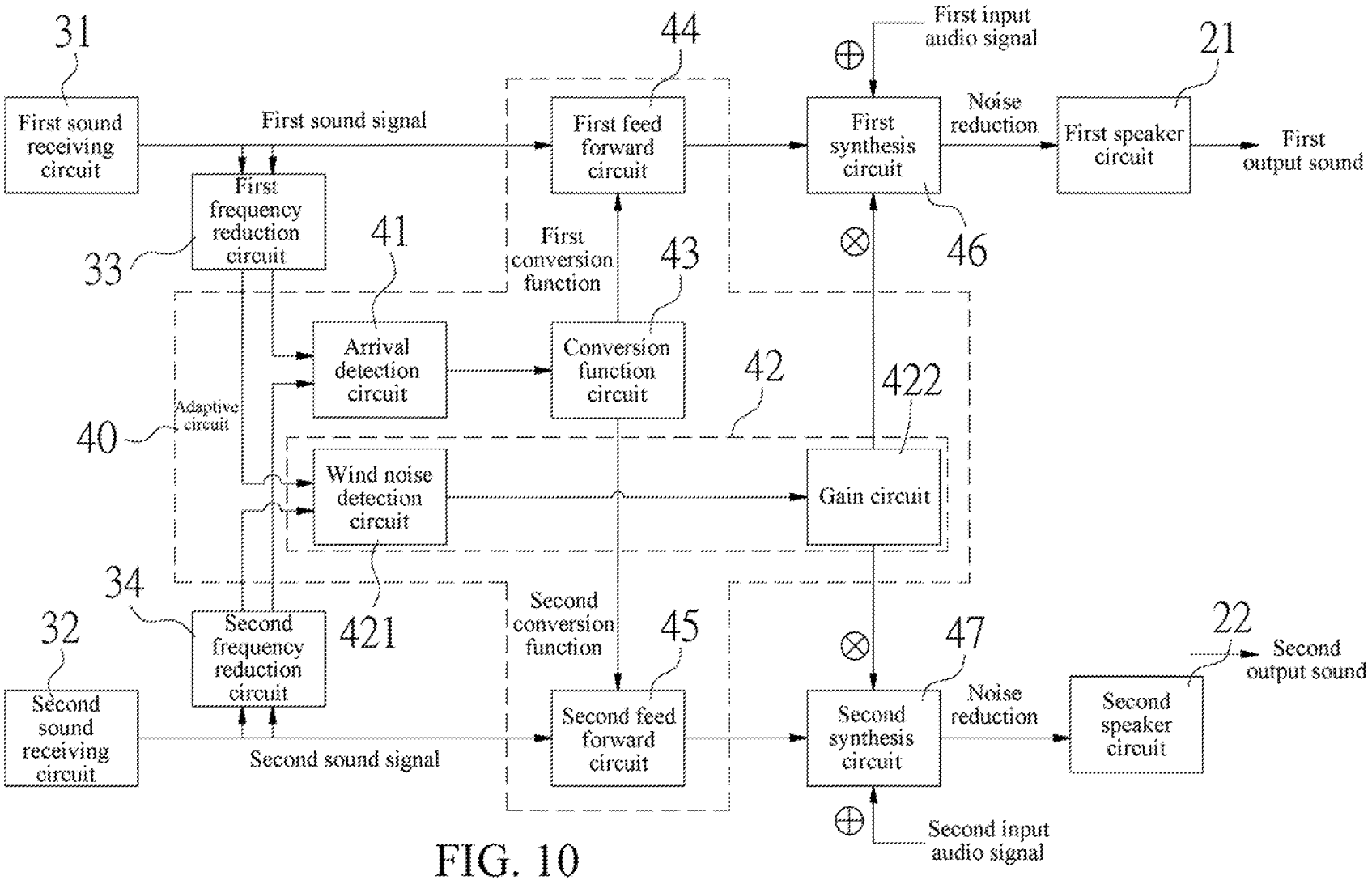
FIG. 10 is a schematic diagram of a circuit structure of a headset according to Embodiment 5 of the present disclosure.

Referring to FIG. 10, Embodiment 5 of the present disclosure describes a headset 100. A difference between Embodiment 5 and Embodiment 1 lies in that the headset 100 further includes a frequency reduction circuit, for example, a digital frequency reduction filter. For example, a first frequency reduction circuit 33 is electrically connected to a first sound receiving circuit 31 and is configured to reduce a frequency of a first sound signal. A second frequency reduction circuit 34 is electrically connected to a second sound receiving circuit 32 and is configured to reduce a frequency of a second sound signal. An adaptive circuit 40 is configured to obtain a first direction of arrival and a second direction of arrival according to the first sound signal and the second sound signal of which frequencies are reduced. An example of a wireless headset is used. The wireless headset includes wireless communications circuits respectively disposed in an earpiece corresponding to a left ear area and an earpiece corresponding to a right ear area, and configured to transmit or receive a sound signal. Before a first wireless communications circuit corresponding to a left ear area of a person receives the second sound signal, the second frequency reduction circuit 34 corresponding to a right ear area of the person first reduces the frequency of the second sound signal, and a second communications circuit transmits the second sound signal of which the frequency is reduce to the first wireless communications circuit.

Figure 11:
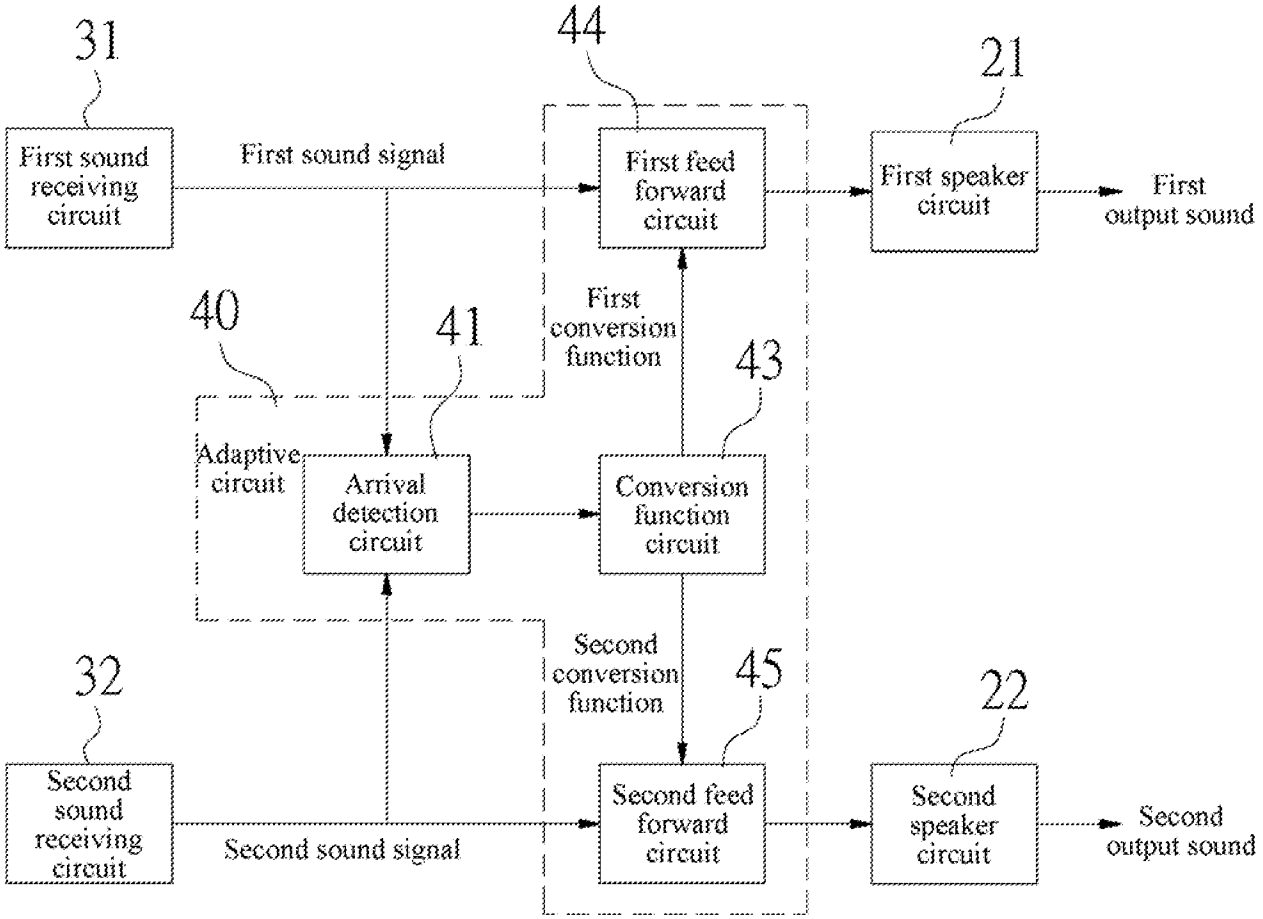
FIG. 11 is a schematic diagram of a circuit structure of a headset according to Embodiment 6 of the present disclosure.

Referring to FIG. 11, Embodiment 6 of the present disclosure describes a headset 100. A difference between Embodiment 6 and Embodiment 1 lies in that a first synthesis circuit 46 and a second synthesis circuit 47 are included, but a first feed forward circuit 44 is electrically connected to a first speaker circuit 21, and a second feed forward circuit 45 is electrically connected to a second speaker circuit 22. Further, the first speaker circuit 21 receives a first feed forward audio signal output by the first feed forward circuit 44, converts the first feed forward audio signal into a first output sound, and then outputs the first output sound. The second speaker circuit 22 receives a second feed forward audio signal output by the second feed forward circuit 45, converts the second feed forward audio signal into a second output sound, and then outputs the second output sound. Therefore, the first output sound can cancel a first sound that reaches a third position, and the third position corresponds to a position that is of the first speaker circuit 21 and that is close to a left ear portion U. The second output sound can cancel a second sound that reaches a fourth position, and the fourth position corresponds to a position that is of the second speaker circuit 22 and that is close to a right ear portion U.

In some embodiments, an arrival detection circuit 41 is configured to obtain a first direction of arrival ϕ and a second direction of arrival ϕ according to a first sound signal and a second sound signal of which frequencies are reduced.

In some embodiments, a wind noise detection circuit 421 is configured to: receive the first sound signal and the second sound signal of which the frequencies are reduced, and output a wind noise figure when determining that a wind noise intensity of the first sound signal and the second sound signal of which the frequencies are reduced is greater than a preset value.

Figure 12:
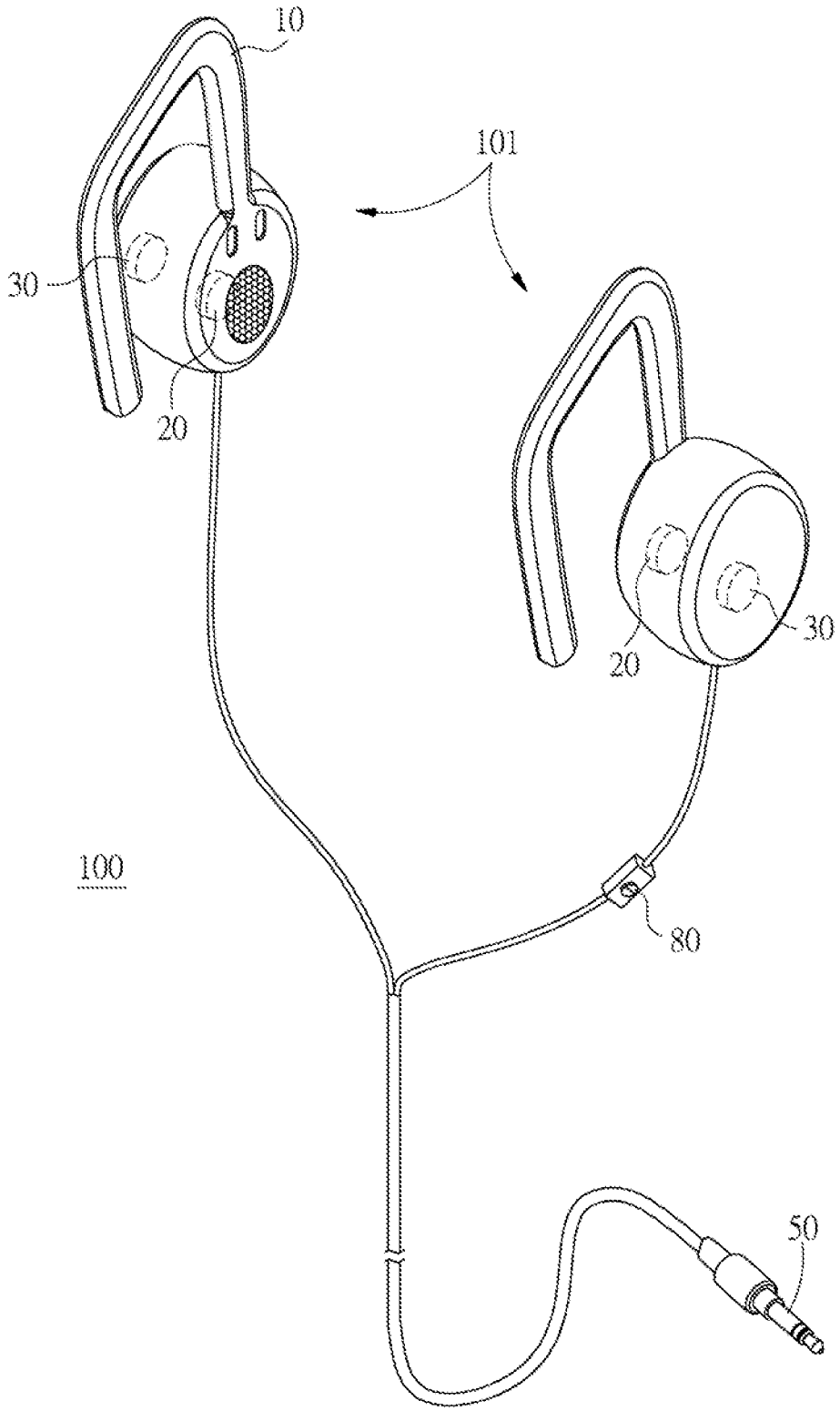
FIG. 12 is a schematic diagram of a hardware structure of a headset according to Embodiment 2 of the present disclosure.

In some embodiments, as shown in FIG. 12, the headset 100 may be an ear-bud style headset 101. The ear-bud style headset 101 and the circumaural headphone 103 are almost the same in internal structure, and only one difference lies in that the circumaural headphone 103 further includes an ear cushion 70, configured to cover the ear portion U.

Figure 13:
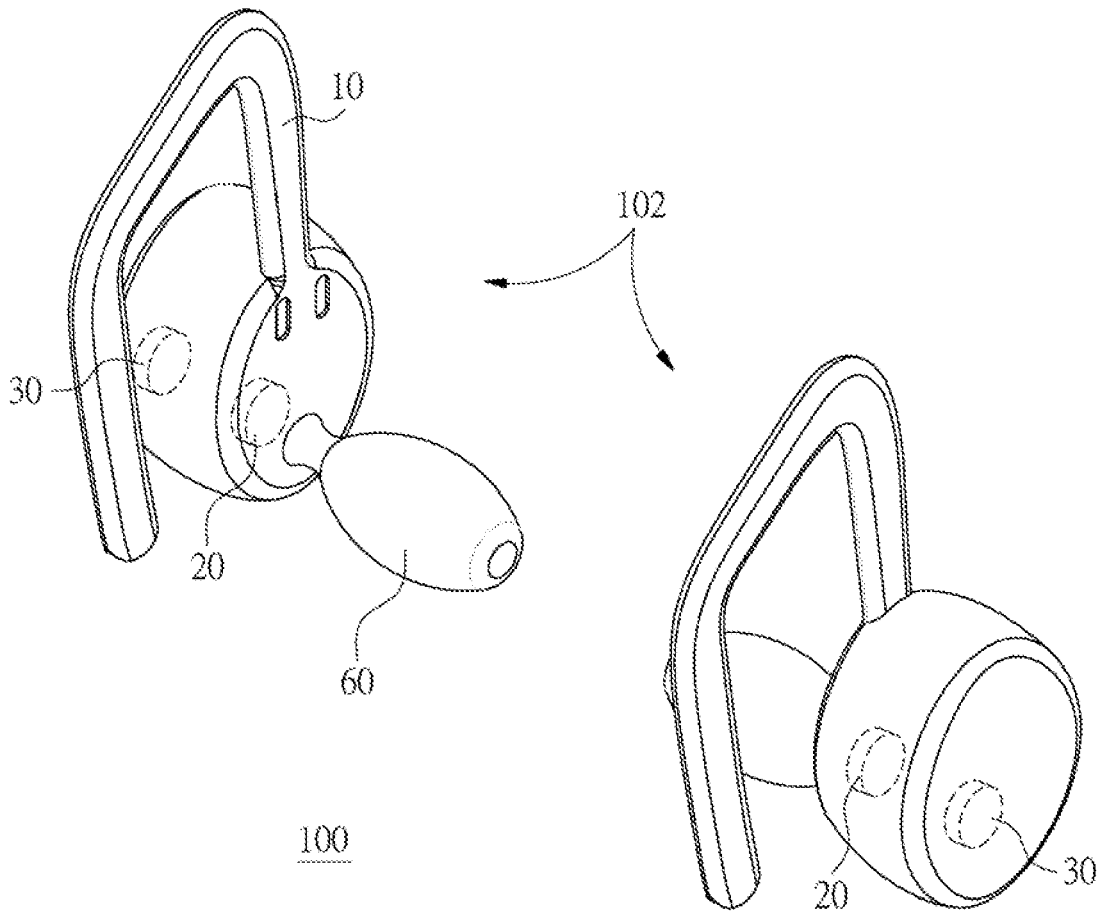
FIG. 13 is a schematic diagram of a hardware structure of a headset according to Embodiment 3 of the present disclosure.

In some embodiments, as shown in FIG. 13, the headset 100 may be an ear-plug style headset 102. The ear-plug style headset 102 and the ear-bud style headset 101 are almost the same in internal structure, and only one difference lies in that the ear-plug style headset 102 further includes an earplug 60, configured to be connected to a housing 10.

Figure 14:
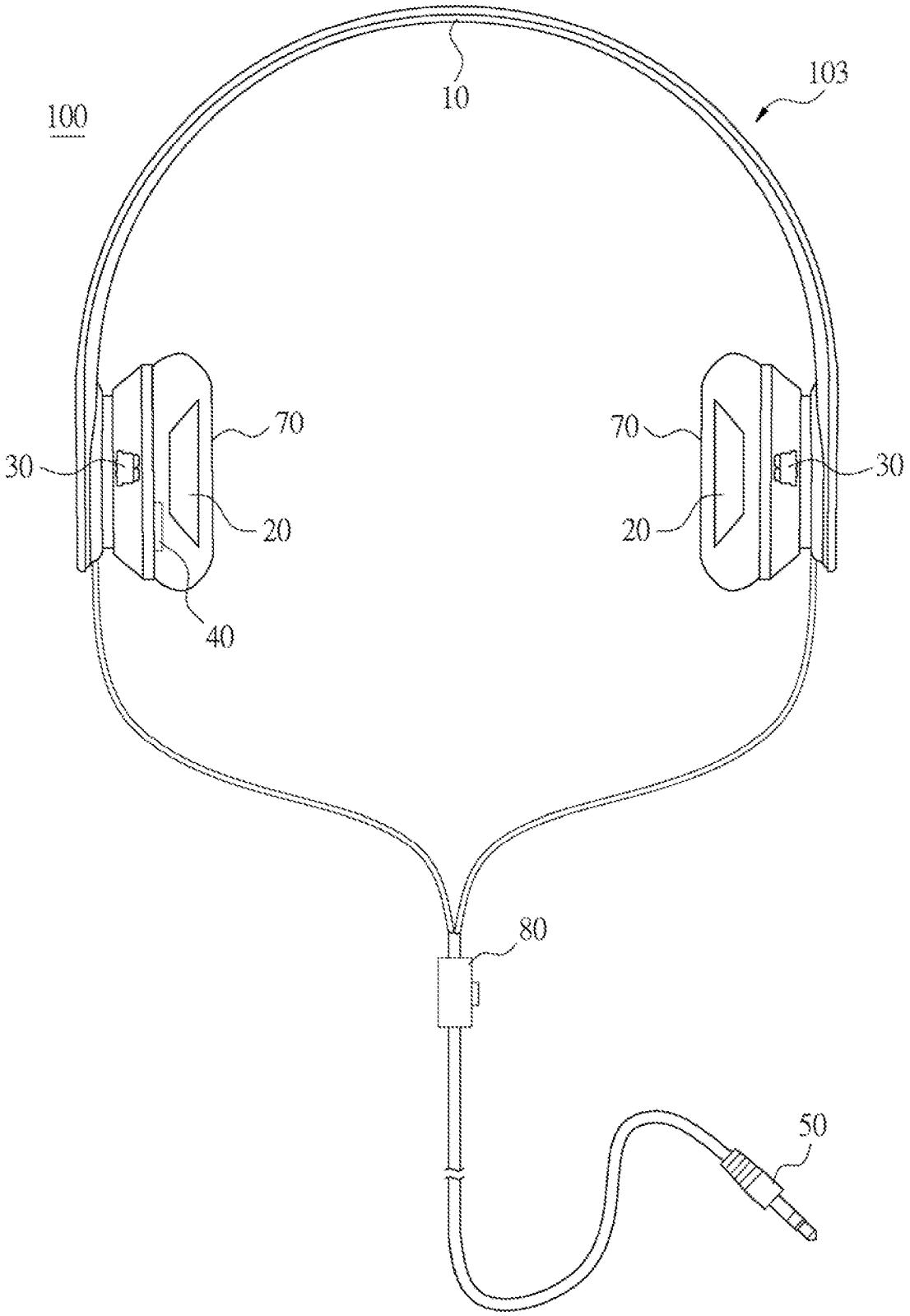
FIG. 14 is a schematic diagram of a hardware structure of a headset according to Embodiment 4 of the present disclosure.
Figure 15:
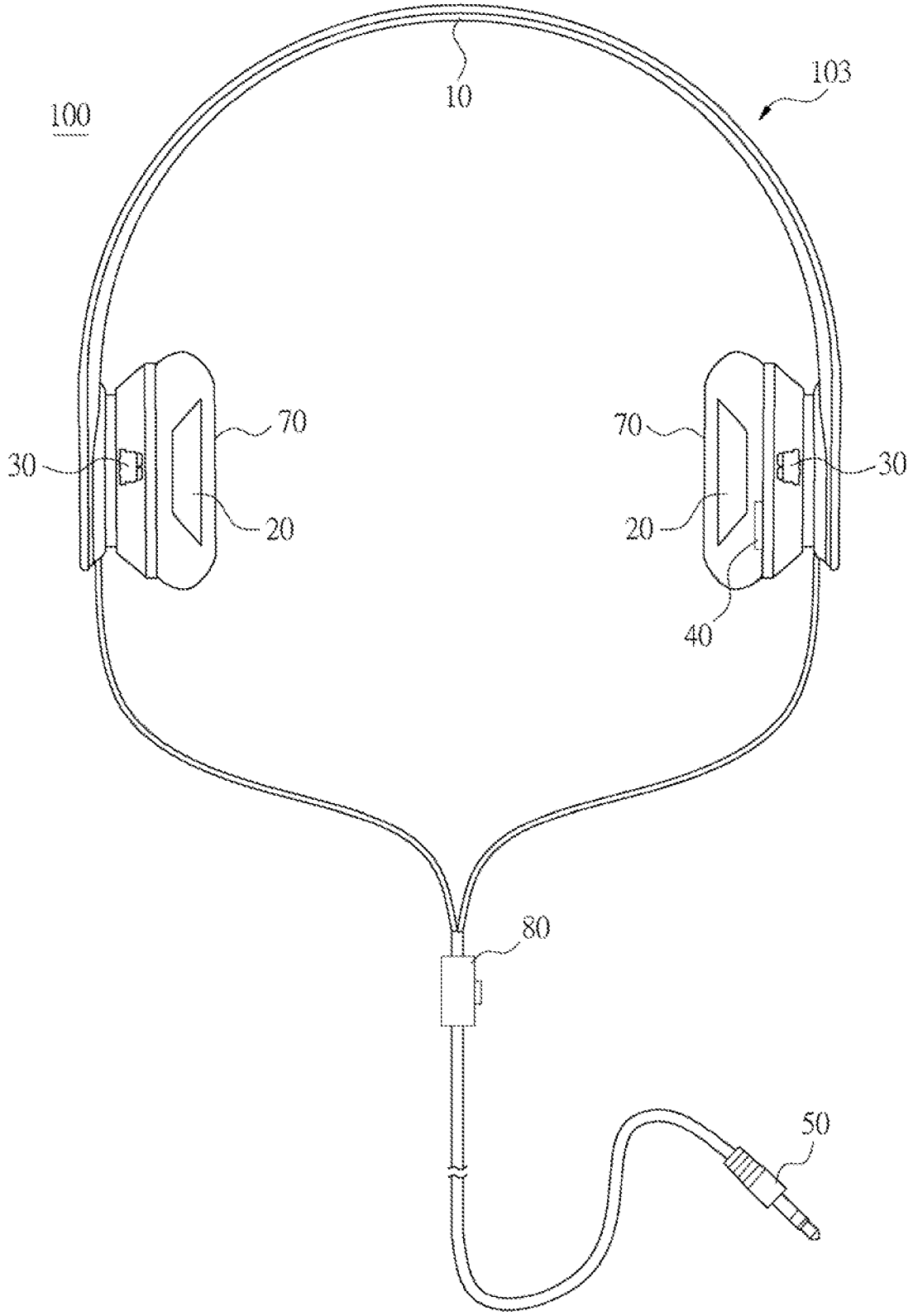
FIG. 15 is a schematic diagram of a hardware structure of a headset according to Embodiment 5 of the present disclosure.

In some embodiments, as shown in FIG. 14, an adaptive circuit 40 is disposed at a first position. Specifically, the adaptive circuit 40 is disposed at the first position, and the first position corresponds to a left ear area of a person, but is not limited hereto. In some embodiments, as shown in FIG. 15, the adaptive circuit 40 is disposed at a second position, and the second position corresponds to a right ear area of the person.

Figure 16:
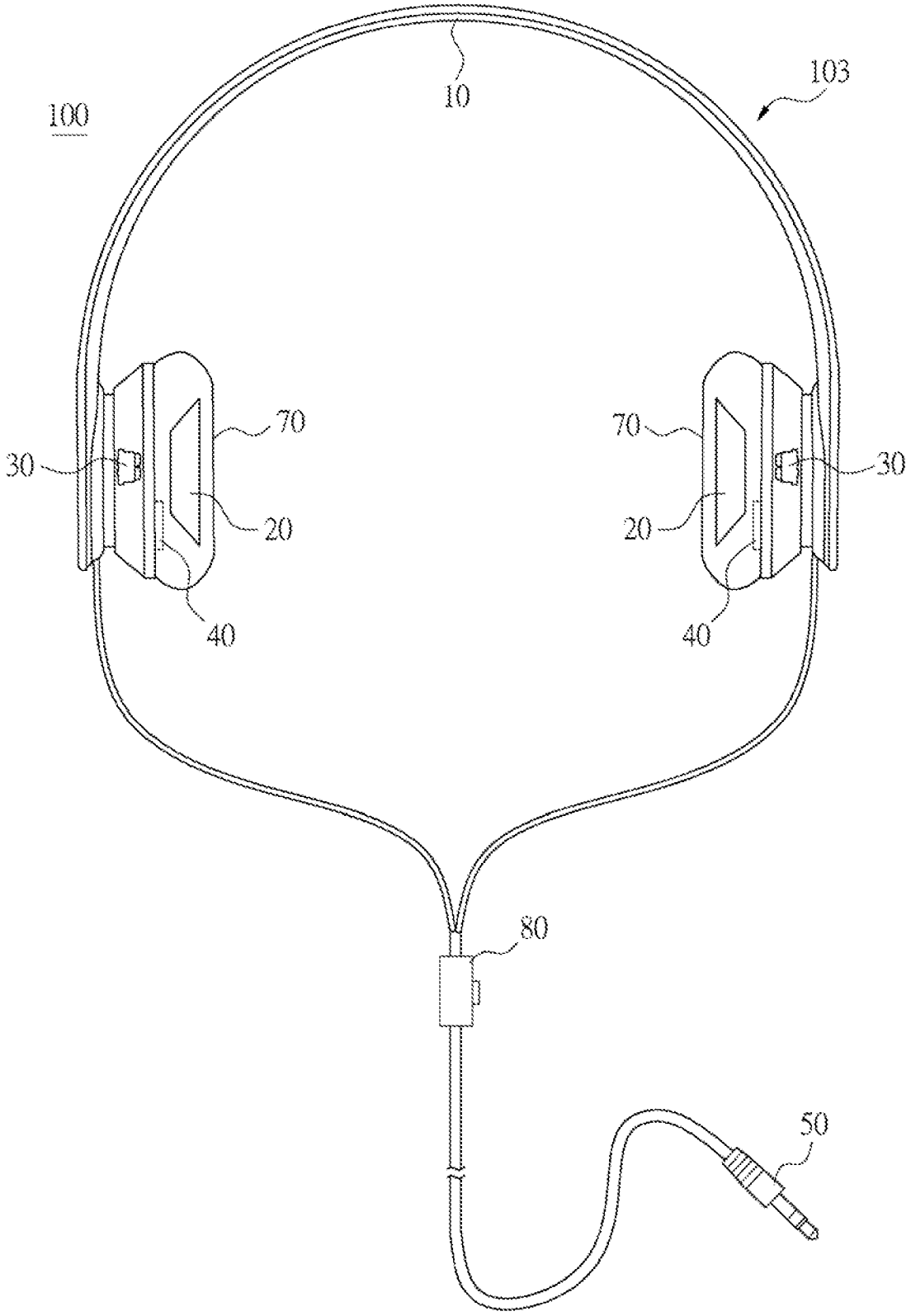
FIG. 16 is a schematic diagram of a hardware structure of a headset according to Embodiment 6 of the present disclosure.

In some embodiments, as shown in FIG. 16, the adaptive circuits 40 are respectively disposed at the first position and the second position. Specifically, as shown in FIG. 2, two adaptive circuits 40 are respectively disposed at the first position and the second position, the first position corresponds to the left ear area of the person, and the second position corresponds to the right ear area of the person. The two adaptive circuits 40 may be alternately started or one of the two adaptive circuits 40 is started according to a scheduling. For example, the adaptive circuit 40 disposed at the first position is started and the adaptive circuit 40 disposed at the second position is not started, so that the adaptive circuit 40 disposed at the first position wiredly or wirelessly receives the second sound signal from the second position. For example, the adaptive circuit 40 disposed at the first position is not started and the adaptive circuit 40 disposed at the second position is started, so that the adaptive circuit 40 disposed at the second position wiredly or wirelessly receives the first sound signal from the first position. When the adaptive circuits 40 disposed at the first position and the second position are started at the same time according to a scheduling, the adaptive circuit 40 disposed at the first position wiredly or wirelessly receives the second sound signal from the second position, and the adaptive circuit 40 disposed at the second position wiredly or wirelessly receives the first sound signal from the first position.

Figure 17:
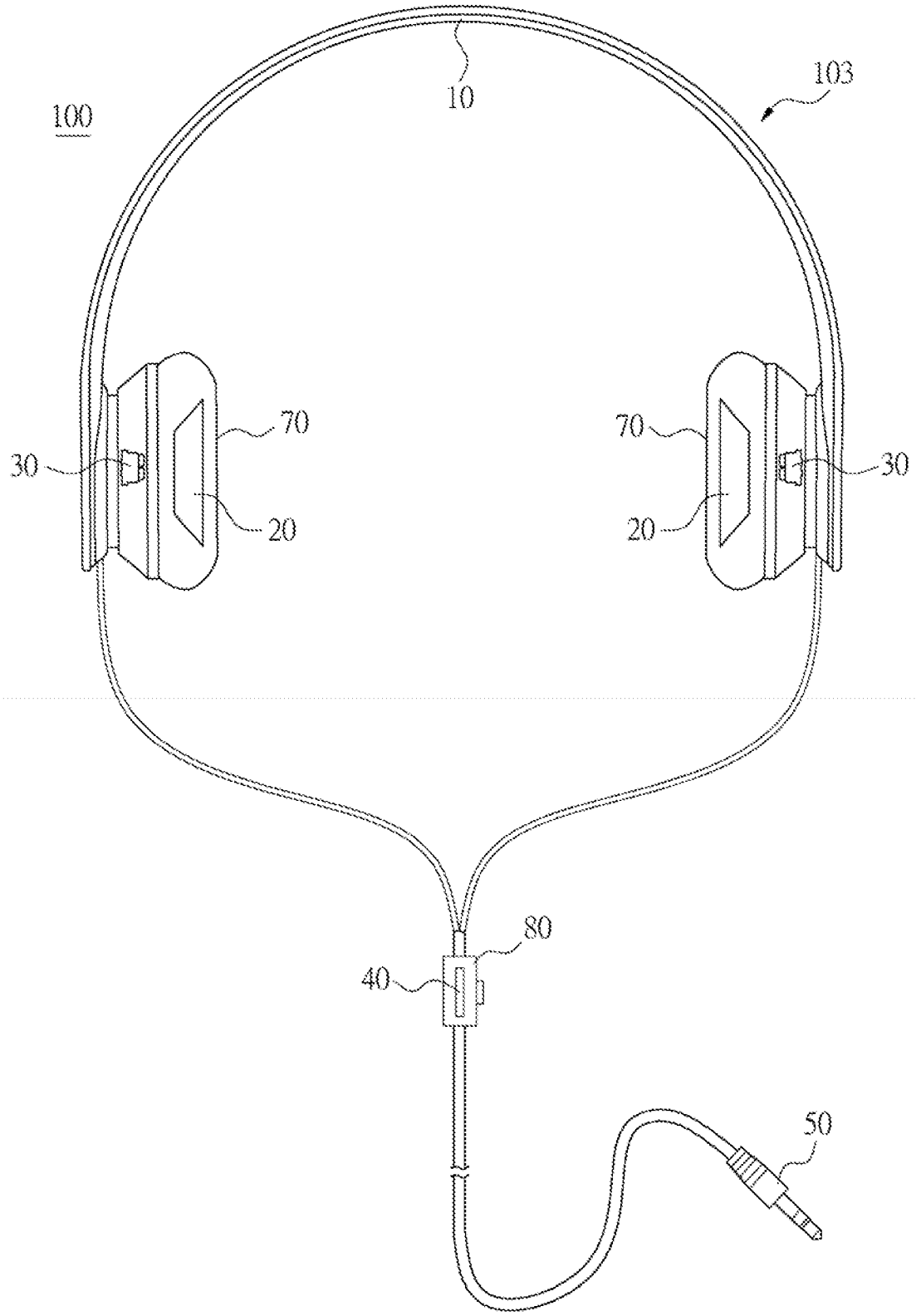
FIG. 17 is a schematic diagram of a hardware structure of a headset according to Embodiment 7 of the present disclosure.

In some embodiments, the headset 100 further includes a control interface 80 disposed on an audio source cable 50. The control interface 80 is configured to: adjust loudness of the first output sound and the second output sound, and start or suspend output of the first output sound and the second output sound. In some embodiments, as shown in FIG. 17, the adaptive circuit 40 is disposed at a third position, that is, corresponds to the control interface 80.

In some embodiments, a conversion function circuit 43 is disposed at the first position or the second position.

In some embodiments, as shown in FIG. 13, the headset 100 may alternatively not include the audio source cable 50, but is provided with a wireless communications circuit, for example, a Bluetooth headset, or an infrared headset.

In some embodiments, the arrival detection circuit 41 may also obtain a first direction of arrival $\phi$ of a first noise source and a second direction of arrival $\phi$ of a second noise source according to the a sound signal and a second sound signal from different noise sources. The arrival detection circuit 41 is disposed at the first position or the second position.

Unless otherwise explicitly specified or limited, terms "coupling" and "connection" should be understood in a broad sense. For example, the connection may be a fixed connection, a detachable connection, or an integrated connection; may be a mechanical connection or an electrical connection; may be a wired connection or a wireless connection, or may be a direct connection, a connection by using an intermediary, or a communication between internal portions of two elements. A person skilled in the art may understand specific meanings of the foregoing terms in the present disclosure according to a specific situation.

In conclusion, according to one or more embodiments of the present disclosure, the headset 100 corresponding to the left ear area and the right ear area of the person may determine the first direction of arrival $\phi$ of the first sound signal and the second direction of arrival $\phi$ of the second sound signal according to the frequency band of the first sound signal and the frequency band of the second sound signal, and then use the first direction of arrival $\phi$ and the second direction of arrival $\phi$ as indicators to obtains through searching the lookup table, the transfer functions corresponding to the indicators, to dynamically adjust the first feed forward circuit 44 corresponding to the left ear area of the person or the second feed forward circuit 45 corresponding to the right ear area of the person, so that the first speaker circuit 21 outputs the first output audio signal that approaches or equals the first input audio signal to cancel the first sound signal, and the second speaker circuit 22 outputs the second output audio signal that approaches or equals the second input audio signal to cancel the second sound signal.

What is claimed is:

1. A headset, comprising:

a first sound receiving circuit, configured to: receive a first sound of a first position, and convert the first sound into a first sound signal;

a second sound receiving circuit, configured to: receive a second sound of a second position, and convert the second sound into a second sound signal;

an adaptive circuit, configured to: obtain a first direction of arrival and a second direction of arrival according to the first sound signal and the second sound signal; obtain a first conversion function and a second conversion function according to the first direction of arrival and the second direction of arrival; obtain a first feed forward audio signal according to the first conversion function and the first sound signal; and obtain a second feed forward audio signal according to the second conversion function and the second sound signal, wherein the first conversion function and the second conversion function respectively comprise phase differences and gain values corresponding to different frequencies;

a first synthesis circuit, configured to: mix a first input audio signal and the first feed forward audio signal, and output a first output audio signal; and a second synthesis circuit, configured to: mix a second input audio signal and the second feed forward audio signal, and output a second output audio signal.

2. The headset according to claim 1, wherein the adaptive circuit comprises:

an arrival detection circuit, configured to obtain the first direction of arrival and the second direction of arrival according to the first sound signal and the second sound signal;

a conversion function circuit, configured to obtain the first conversion function and the second conversion function according to the first direction of arrival and the second direction of arrival;

a first feed forward circuit, configured to obtain the first feed forward audio signal according to the first conversion function and the first sound signal; and a second feed forward circuit, configured to obtain the second feed forward audio signal according to the second conversion function and the second sound signal.

3. The headset according to claim 2, wherein the conversion function circuit comprises a lookup table, and the conversion function circuit searches the lookup table for the corresponding first conversion function and the corresponding second conversion function according to the first direction of arrival and the second direction of arrival.

4. The headset according to claim 1, further comprising:

a wind noise feedback circuit, configured to: receive the first sound signal and the second sound signal, and output a corresponding wind noise audio signal when determining that a wind noise intensity of the first sound signal and the second sound signal is less than a preset value, wherein the first synthesis circuit is configured to: mix the first input audio signal, the first feed forward audio signal, and the wind noise audio signal, and output the first output audio signal; and the second synthesis circuit is configured to: mix the second input audio signal, the second feed forward audio signal, and the wind noise audio signal, and output the second output audio signal.

5. The headset according to claim 4, wherein the wind noise feedback circuit comprises:

a wind noise detection circuit, configured to: receive the first sound signal and the second sound signal, and output a wind noise figure when determining that the wind noise intensity of the first sound signal and the second sound signal is less than the preset value; and a gain circuit, configured to output the wind noise audio signal according to the wind noise figure.

6. The headset according to claim 1, further comprising:

a wind noise feedback circuit, configured to: receive the first sound signal and the second sound signal, and output a corresponding wind noise parameter when determining that a wind noise intensity of the first sound signal and the second sound signal is less than a preset value, wherein the adaptive circuit is configured to: obtain the first feed forward audio signal according to the first conversion function, the first sound signal, and the wind noise parameter; and obtain the second feed forward audio signal according to the second conversion function, the second sound signal, and the wind noise parameter.

7. The headset according to claim 6, wherein the adaptive circuit comprises:

an arrival detection circuit, configured to obtain the first direction of arrival and the second direction of arrival according to the first sound signal and the second sound signal;

a conversion function circuit, configured to obtain the first conversion function and the second conversion function according to the first direction of arrival, the second direction of arrival, and the wind noise parameter;

a first feed forward circuit, configured to obtain the first feed forward audio signal according to the first conversion function and the first sound signal; and a second feed forward circuit, configured to obtain the second feed forward audio signal according to the second conversion function and the second sound signal.

8. The headset according to claim 6, wherein the wind noise feedback circuit comprises:

a wind noise detection circuit, configured to: receive the first sound signal and the second sound signal, and output a wind noise figure when determining that the wind noise intensity of the first sound signal and the second sound signal is less than the preset value; and a gain circuit, configured to output the wind noise parameter according to the wind noise figure.

9. The headset according to claim 6, further comprising at least one frequency reduction circuit, configured to reduce a frequency of a first sound signal and a second sound signal; and the adaptive circuit configured to obtain the first direction of arrival and the second direction of arrival according to the reduced first sound signal and the reduced second sound signal.

10. The headset according to claim 1, further comprising at least one frequency reduction circuit, configured to reduce a frequency of a first sound signal and a second sound signal; and the adaptive circuit configured to obtain the first direction of arrival and the second direction of arrival according to the reduced first sound signal and the reduced second sound signal.

11. A headset, comprising:

a first sound receiving circuit, configured to: receive a first sound of a first position, and convert the first sound into a first sound signal;

a second sound receiving circuit, configured to: receive a second sound of a second position, and convert the second sound into a second sound signal; and an adaptive circuit, configured to: obtain a first direction of arrival and a second direction of arrival according to the first sound signal and the second sound signal; obtain a first conversion function and a second conversion function according to the first direction of arrival and the second direction of arrival; output a first feed forward audio signal according to the first conversion function and the first sound signal; and output a second feed forward audio signal according to the second conversion function and the second sound signal, wherein the first conversion function and the second conversion function respectively comprise phase differences and gain values corresponding to different frequencies.

* * * * *